United States Patent [19]

Turk et al.

[11] 4,145,010

[45] Mar. 20, 1979

[54] DEVICE FOR WINDING SYNTHETIC FIBERS

[75] Inventors: Herbert Turk, Remscheid; Herbert Schiminski, Hückeswagen, both of Fed. Rep. of Germany

[73] Assignee: Barmag Barmer Maschinenfabrik AG, Remscheid-Lennep, Fed. Rep. of Germany

[21] Appl. No.: 857,817

[22] Filed: Dec. 5, 1977

[30] Foreign Application Priority Data

Dec. 8, 1976 [DE] Fed. Rep. of Germany ..... 2655544

[51] Int. Cl.[2] ..... B65H 54/42; B65H 67/04

[52] U.S. Cl. ..... 242/18 A

[58] Field of Search ..... 242/18 A, 18 DD, 25 A, 242/56 A

[56] References Cited

U.S. PATENT DOCUMENTS

| | | | |
|---|---|---|---|
| 2,772,054 | 11/1956 | Herele et al. | 242/18 A |
| 2,905,402 | 9/1959 | Foller et al. | 242/18 A |
| 3,090,570 | 5/1963 | Cunningham et al. | 242/18 A |
| 3,279,709 | 10/1966 | Carlson et al. | 242/18 A |
| 3,559,902 | 2/1971 | Brock | 242/18 A |
| 3,825,206 | 7/1974 | Schippers et al. | 242/18 A X |
| 3,841,574 | 10/1974 | Lenk et al. | 242/18 A X |
| 3,999,715 | 12/1976 | Schippers et al. | 242/18 A |
| 4,033,519 | 7/1977 | Abe et al. | 242/18 A |

FOREIGN PATENT DOCUMENTS

| | | | |
|---|---|---|---|
| 1471310 | 1/1967 | France | 242/18 A |

*Primary Examiner*—Stanley N. Gilreath
*Attorney, Agent, or Firm*—John H. Shurtleff

[57] ABSTRACT

An improved peripheral drive device for winding synthetic fibers wherein at least two turnably borne tension mandrel shafts for the reception of bobbin spools are mounted on a bobbin revolver. A servo motor is located on the rear side of the bobbin revolver and is initially positioned in axial alignment with the tension mandrel shaft having an empty bobbin spool mounted thereon which is waiting to be revolved into an operational position in which the fiber is transferred to it and the winding of the fiber upon it begins. The improvement relates to a swing lever fastened at one end of the servo motor and mounted at its other end for rotation during the bobbin changing operation about the axis of rotation of the bobbin revolver. The shaft end of the servo motor is adapted to drivingly engage the rear end of the tension mandrel shafts and a means is provided for axially shifting the servo motor shaft into engagement with the tension mandrel having an empty bobbin spool mounted thereon when this mandrel shaft is in its waiting position and for uncoupling said servo motor shaft when this mandrel shaft has been brought into its operating position by the bobbin revolver.

12 Claims, 4 Drawing Figures

DEVICE FOR WINDING SYNTHETIC FIBERS

INTRODUCTION

The present invention relates to an improved peripheral drive device for winding synthetic fibers and, more particularly, to a device for engaging and accelerating the empty bobbin spool to its operating speed during the bobbin changing operation in a winding device utilizing a bobbin revolver having multiple bobbins mounted thereon.

BACKGROUND OF THE INVENTION

There are a number of devices known for accelerating empty bobbin spools to their required turning speed for thread transfer in peripheral drive machines for winding synthetic fibers wherein several empty bobbin tubes pass successively into the operational winding position. One of such devices is disclosed in German Utility Model, DT-Gbm 75 15 234, and a similar device is shown in U.S. Pat. No. 3,999,715. Such devices generally provide for accelerating the empty spool through frictional contact with the groove roller. However, in order not to damage the first winding layers forming on the empty spool after thread transfer, this device has been constructed so that frictional contact is made by means of run-on rings arranged on the face side of the spool, thereby avoiding direct contact between the empty spool surface and groove roller. The design of this device has the disadvantage that during the bobbin change operation the empty spool cannot be accelerated to the necessary turning speed until it has come into contact with the groove roller. Since this position is the same as that in which the thread transfer takes place, it is necessary to wait until the empty spool has reached its operational speed before initiating thread transfer. A further disadvantage of this device is that the turning rate of the empty spool is not adjustable, even with the use of the run-on rings, which is not desirable in certain thread transfer operations.

Another of such devices is disclosed in U.S. Pat. No. 3,825,206 which provides for accelerating the empty bobbin spool to its operational turning speed before the initiation of the bobbin changing operation through the use of a stationary motor. After the bobbin spool is brought to its operational speed, the bobbin revolver rotates it into the thread changing position. Since with this device the empty bobbin spool is not driven during the turning of the bobbin revolver during thread transfer, under certain circumstances there exists the possibility of the spool slowing down and undesirable slack in the thread being created.

BRIEF DESCRIPTION OF THE INVENTION

In order to solve the above-described problems associated with conventional thread winding devices, the present invention was developed which provides for carrying out the thread transfer continuously without loss of operational time or material in the winding process.

With a device constructed in accordance with the present invention, it is possible to accelerate the empty bobbin spool to its operational speed and maintain it at that level continuously during the bobbin changing operation up until the point it comes into contact with the drive roller, thereby avoiding any waiting time in the thread transfer operation or any undesirable speed difference between the empty bobbin spool and the drive roller. Likewise, the present invention assumes that the required thread tension may be maintained at all times during the thread transfer operation. Furthermore, the present invention provides the additional advantage of allowing the free choice of the turning speed of the empty spool during the changing operation thereby allowing greater flexibility in meeting the special requirements of certain working processes.

The present invention generally provides an auxiliary motor which can be a servo motor, but it also can be all other kind of motor. It can be driven electrically, pneumatically or hydraulically. Said motor is located on the rear side of the bobbin revolver which is initially positioned in axial alignment with the tension mandrel which is built up as a chuck having an empty bobbin spool mounted thereon which is waiting to be revolved into an operational position in which the fiber is transferred to it and the winding of the fiber upon it begins. A swing lever is fastened at one end to the servo motor and is mounted at its other end for rotation during the bobbin changing operation about the axis of rotation of the bobbin revolver. The shaft end of the servo motor is adapted to drivingly engage the rear end of the tension mandrel shafts and a means is provided for axially shifting the servo motor shaft into engagement with the tension mandrel having an empty bobbin spool mounted thereon when this mandrel shaft is in a waiting position and for uncoupling the servo motor shaft when this mandrel shaft has been brought into its operating position by the bobbin revolver.

In addition, a simple means for shifting the servo motor shaft into and out of engagement with the tension mandrel shafts is disclosed which comprises a piston cylinder attached to the swing lever which is carried by a piston rod mounted at the axis of rotation of the bobbin revolver.

In a further embodiment of the present invention, a force storer mounted on the frame of the winding device is provided which causes the servo motor to recoil back into its waiting position when the mandrel shaft having the empty bobbin spool mounted thereon has been brought into its operating position and the mandrel engaging means is uncoupled therefrom. This embodiment solves the problem of simply resetting the servo motor out of the operating position of the bobbin spool into its waiting position. In this manner, no gears, lever systems, couplings or other mechanical resetting devices are required in order to return the servo motor to its waiting position. In addition, the complexity and corresponding cost of such a force storer may be reduced by providing a simple bolt-spring unit, the bolt of which is driven in by the servo motor being brought into the operating position of the mandrel shaft by the bobbin revolver. By force storer is meant in this invention a force storage unit which can be built up as a spring or a pneumatic cylinder or somewhat else.

DESCRIPTION OF THE PREFERRED EMBODIMENT

Figure 1:
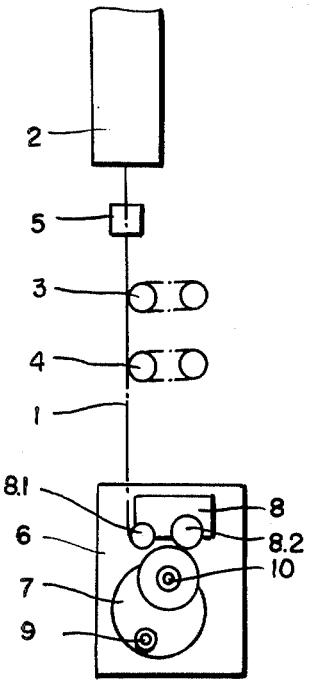
FIG. 1 is a schematic front view of a spinning installation having a winding device constructed in accordance with an embodiment of the present invention.
Figure 2:
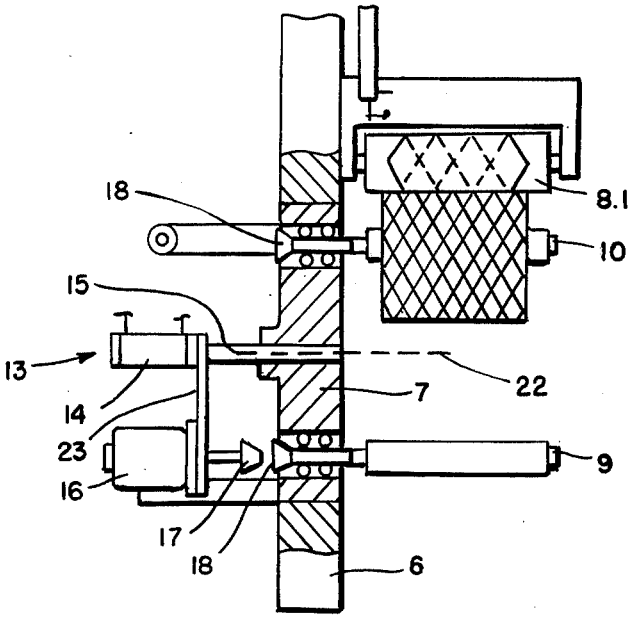
FIG. 2 is a partial, enlarged side view in cross-section of the winding device shown in FIG. 1.
Figure 3:
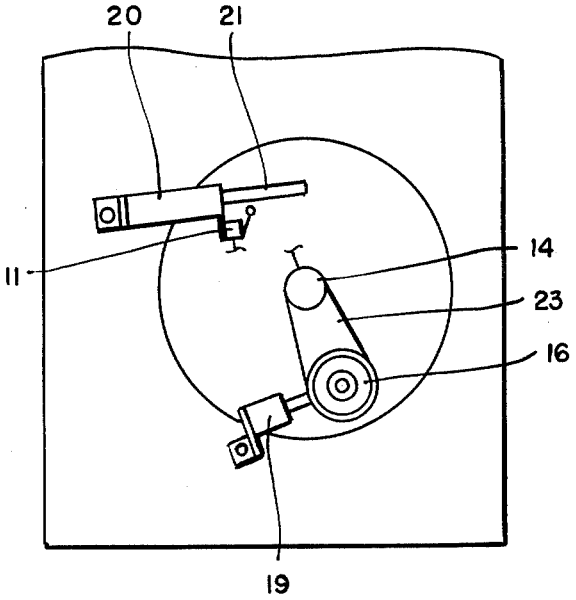
FIG. 3 is a schematic rear view of the winding device shown in FIG. 2.

FIGS. 1-3 illustrate an embodiment of a winding device 6 constructed in accordance with the present invention. Thread 1, which is spun from spinning device 2, is drawn off by stretching godets 3 and 4 past finishing apparatus and thread regulator 5 and is then conveyed to the winding arrangement 6 of the present invention.

Winding device 6 consists of a turnable bobbin revolver 7 and a vertically movable slide piece 8 which is in this case a support or a carriage. On bobbin revolver 7 there are mounted two tension mandrel shafts 9 and 10 for the reception of empty thread tubes. Although only one empty thread tube per mandrel shaft is shown in the drawings, it is customary to accomodate from two to as many as eight of such tubes per mandrel shaft depending upon the application of the arrangement desired. Corresponding to the number of thread tubes placed upon the mandrel shafts, on slide piece 8 there are arranged a number of traverse thread guides. Furthermore, slide piece 8 has a groove roller 8.1 and a drive roller 8.2 mounted thereon.

FIG. 2 illustrates a schematic side view in cross-section of the winding arrangement 6 shown in FIG. 1. Along the axis of rotation 22 of bobbin revolver 7 and on the back side thereof, there is mounted a piston rod 15 of cylinder-piston unit 13. Piston cylinder 14 is carried on piston rod 15 and is axially shiftable thereon.

On axial slidable cylinder 14 there is mounted an electric servo motor 16 which is secured thereto by means of a swinging lever 23 which is turnably borne in the axis of rotation 22 of bobbin revolver 7, the front shaft of which is constructed as a friction cone 17. Friction cone 17 is designed to engage a corresponding counter-cone 18 which forms the rear end of the tension mandrel shafts 9 and 10.

In addition, as is best shown in FIG. 3, on the back of bobbin revolver 7, a shock absorber 19 is fastened to the machine frame of winding device 6 which engages servo motor 16 in its rest position. Similarly, a force storer 20 is fastened to the machine frame, which is constructed as a bolt-spring unit in the preferred embodiment, is designed to engage servo motor 16 in its upper rotational position. Force storer 20 consists of a bolt or piston rod 21 which is held in the extended position (starting position) as is shown in FIG. 3 by the pressure of a spring (not shown) which is housed within the unit. In addition to force storer 20, there is also mounted on the machine frame a pneumatic switch 11 which is operable by servo motor 16 when it is rotated into its upper position.

Figure 4:
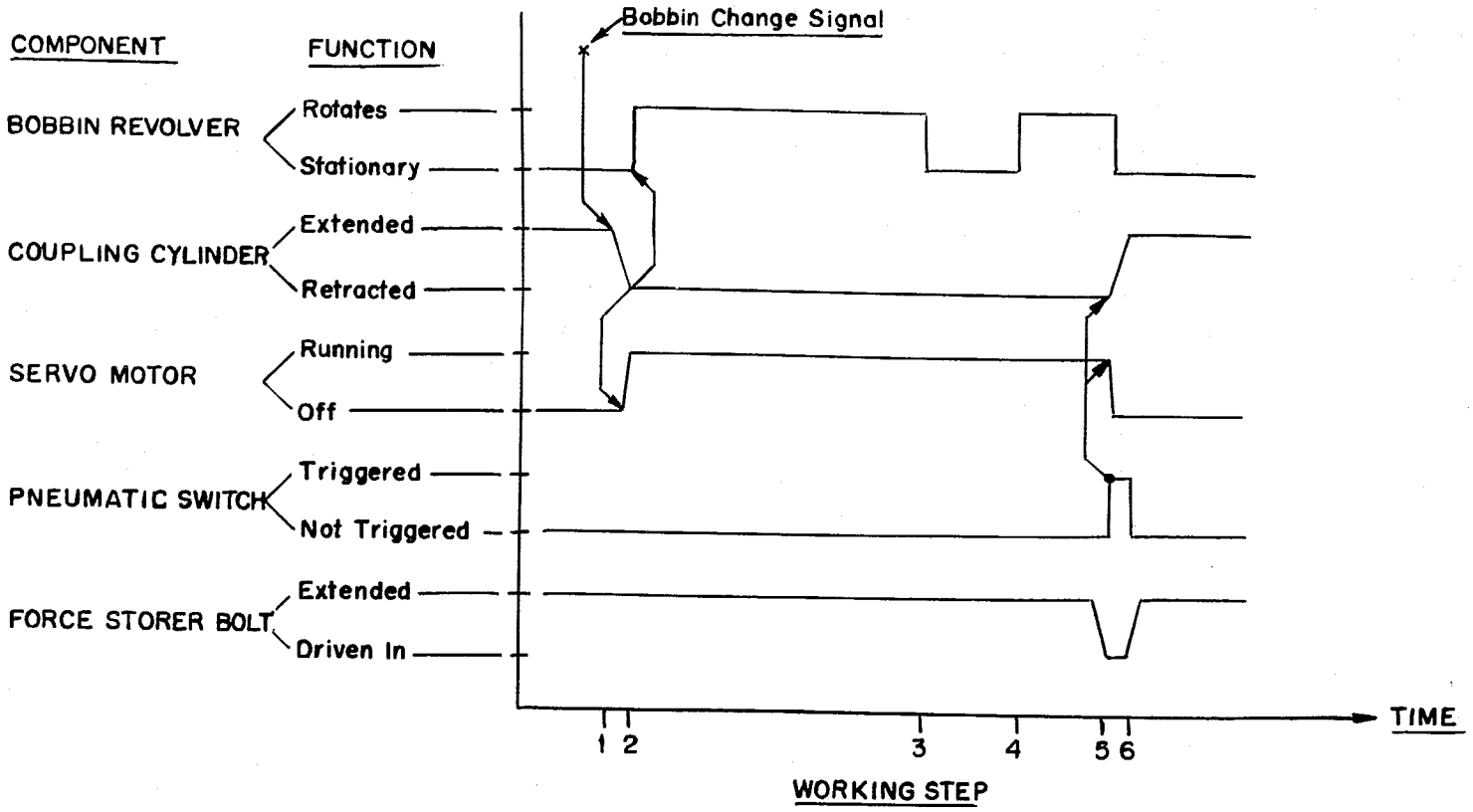
FIG. 4 is a diagram illustrating the operational steps of the winding device shown in FIGS. 2 and 3.

The operational functioning of the winding arrangement of the present invention will now be explained in detail with the aid of the run-off diagram presented in FIG. 4.

During the winding process, the bobbins and servo motor 16 are positioned in the relationship shown in FIG. 3. When a signal for bobbin change is triggered by means of a known device, such as a bobbin diameter sensor, slide piece position sensor or other suitable signalling arrangement, coupling cylinder 14 is driven inward along piston rod 15 and in this manner the friction cone 17 of servo motor 16 is brought into engagement with the counter-cone 18 of empty tension mandrel shaft 9. (This operation is illustrated as working step 1 in FIG. 4.) In this connection, it is also noted that the inward driving of servo motor 16 by coupling cylinder 14 may also be made dependent upon its proper positioning with respect to counter-cone 18 so that if such positioning is not present, coupling cylinder 14 will be prevented from operating thereby avoiding possible damage to the apparatus.

After servo motor 16 is brought into engagement with mandrel shaft 9, working step 2 is triggered by an end switch (not shown) which is operated by the snapped-in servo motor 16 or coupling cylinder 14. As is illustrated in FIG. 4, the triggering of this switch causes servo motor 16 to be switched on and bobbin revolver 7 to be simultaneously turned counter clockwise about axis 22. During this rotary movement of the bobbin revolver, servo motor 16 accelerates the empty bobbin tube to the desired turning speed of the thread transport.

When the empty bobbin tube is rotated in front of groove roller 8.1, the rotation of revolver 7 is interrupted as is illustrated by working step 3. Servo motor 16 remains engaged and thread transfer is accomplished to the empty bobbin spool.

When the thread transfer is completed, bobbin revolver 7 begins rotation again in a counter-clockwise direction at an increased turning rate until the empty bobbin tube is brought into its proper working position corresponding to the position of bobbin tube 10 in FIGS. 2 and 3 (working step 4). When this occurs, servo motor 16 triggers pneumatic switch 11 which causes servo motor 16 to be switched off and coupling cylinder 14 to be driven back since the drive of the thread winding forming on the empty bobbin may now be taken over by the drive roller 8.2 (working step 5).

Simultaneously with the empty bobbin reaching its desired working position, servo motor 16 is thrust against bolt 21 of force storer 20. Hence, after servo motor 16 is released from tension mandrel shaft 9 by the withdrawal of coupling cylinder 14, force storer 20 will cause it to recoil clockwise back into its original starting position as is shown in FIGS. 2 and 3 (working step 6). As the recoiling servo motor 16 rotates into its original starting position, it will be braked by shock absorber 19 and will once again be properly positioned axially with respect to the new empty bobbin tube on bobbin revolver 7. In this manner, the bobbin changing operation may be repeated automatically after the complete winding of each bobbin.

Although only one particular embodiment of the present invention has been shown and described in detail, it should be understood that various obvious changes and modification thereto may be made, and it is therefore intended in the following claims to include all such modifications and changes as may fall within the spirit and scope of this invention.

What is claimed is:

1. In a peripheral drive device for winding synthetic fibers wherein at least two turnably borne tension mandrel shafts for the reception of bobbin spools are mounted on a bobbin revolver having a servo motor located on the rear side thereof which is initially positioned in axial alignment with the tension mandrel shaft having an empty bobbin spool mounted thereon which is waiting to be revolved into an operational position in which the fiber is transferred to it and the winding of the fiber upon it begins, the improvement comprising:

a swing lever fastened at one end to the servo motor and mounted at its other end for rotation about the axis of rotation of the bobbin revolver;

means mounted on said servo motor for drivingly engaging said tension mandrel shafts; and means for axially shifting said mandrel engaging means so as to engage said tension mandrel shaft having an empty bobbin spool mounted thereon when said mandrel shaft is in its waiting position and for uncoupling said engaging means when said mandrel shaft has been brought into its operating position by said bobbin revolver.

2. The winding device of claim 1 further comprising a stop mounted on the frame of said winding device for positioning said servo motor with respect to said waiting mandrel shaft.

3. The winding device of claim 2 wherein said stop comprises a shock absorber.

4. The winding device of claim 1 wherein said swing lever and attached servo motor are axially shiftable so as to engage and uncouple said mandrel engaging means.

5. The winding device of claim 4 wherein said axial shifting means comprises a piston cylinder attached to said swing lever which is carried on a piston rod mounted at the axis of rotation of said bobbin revolver.

6. The winding device of claim 1 further comprising a means for causing said servo motor to recoil back into its initial position when said mandrel shaft has been brought into its operating position and said mandrel engaging means is uncoupled therefrom.

7. The winding device of claim 6 wherein said recoil means comprises a force storer mounted on the frame of said winding device.

8. The winding device of claim 7 wherein said force storer comprises a bolt-spring unit in which the bolt of said unit is driven in by the servo motor being brought into the operating position of said mandrel shaft by said bobbin revolver.

9. The winding device of claim 1 wherein said mandrel engaging means comprises a friction cone mounted on the front shaft of said servo motor which is designed to drivingly engage a corresponding counter-cone which forms the rear end of said tension mandrel shafts.

10. A method of changing bobbins in a peripheral drive device for winding synthetic fibers wherein at least two turnably borne tension mandrel shafts for the reception of bobbin spools are mounted on a bobbin revolver having a servo motor located on the rear side thereof which is initially positioned in axial alignment with the tension mandrel shaft having an empty bobbin spool mounted thereon which is waiting to be revolved into an operational position in which the fiber is transferred to it and the winding of the fiber upon it begins, said method comprising:

drivingly engaging said servo motor in its initial position with said tension mandrel shaft having an empty bobbin spool mounted thereon;

accelerating said empty bobbin spool to a predetermined turning rate by means of said servo motor;

rotating said empty bobbin spool and driving servo motor to the operating position of said bobbin spool by means of said bobbin revolver;

uncoupling said servo motor from said mandrel shaft having said empty bobbin spool mounted thereon; and recoiling said servo motor back into its initial position.

11. The method of claim 10 further comprising the steps of:

stopping said bobbin revolver prior to said empty bobbin spool reaching its operating position so as to facilitate transfer of the fiber to be wound thereon; and rotating said bobbin revolver fully to the operating position of said bobbin spool.

12. The method of claim 11 wherein the rotation of said bobbin revolver subsequent to said fiber transfer occurs at an increased turning rate.

* * * * *